US006149411A

United States Patent [19]

Bush

[11] Patent Number: 6,149,411

[45] Date of Patent: Nov. 21, 2000

[54] VARIABLE FLANK RELIEF FOR SCROLL WRAPS

[75] Inventor: James W. Bush, Skaneateles, N.Y.

[73] Assignee: Carrier Corporation, Farmington, Conn.

[21] Appl. No.: 09/238,383

[22] Filed: Jan. 27, 1999

[51] Int. Cl.[7] ..... F01C 1/02

[52] U.S. Cl. ..... 418/55.2; 418/55; 418/50; 29/888.022; 29/23.5

[58] Field of Search ..... 418/55.2, 55, 50; 29/888.022, 23.5

[56] References Cited

U.S. PATENT DOCUMENTS

| | | | |
|---|---|---|---|
| 4,129,405 | 12/1978 | McCullough | 418/55 |
| 4,160,629 | 7/1979 | Hidden et al. | 418/55 |
| 4,395,205 | 7/1983 | McCullough | 418/55 |
| 4,512,066 | 4/1985 | McCullough | 29/23.5 |
| 4,609,334 | 9/1986 | Muir et al. | 418/55 |
| 4,678,415 | 7/1987 | Hirano et al. | 418/50 |
| 4,678,416 | 7/1987 | Hirano et al. | 418/55 |
| 4,927,341 | 5/1990 | Bush . | |
| 5,342,184 | 8/1994 | Comparin et al. | 418/55.2 |
| 5,425,626 | 6/1995 | Tojo et al. | 418/55.2 |

FOREIGN PATENT DOCUMENTS

| | | | |
|---|---|---|---|
| 411082332A | 3/1999 | Japan | 418/48 |

*Primary Examiner*—John J. Vrablik
*Assistant Examiner*—Thai-Ba Trieu
*Attorney, Agent, or Firm*—Howard & Howard

[57] ABSTRACT

A scroll compressor having a non-uniform generating radius for its scroll wraps is formed to have a flank relief which is greatest at locations having the highest generating radius. In scroll compressors having non-uniform generating radii, there is an increased likelihood of contact at the areas having the highest generating radius. Thus, flank relief is provided at the areas having the higher generating radii. In addition, the flank relief is preferably proportional to the generating radius. Further at areas having a generating radius below a predetermined minimum, no flank relief is necessary.

7 Claims, 2 Drawing Sheets

VARIABLE FLANK RELIEF FOR SCROLL WRAPS

BACKGROUND OF THE INVENTION

This invention relates to an improvement in flank relief to correct for rotational misalignment on non-constant generating radius scroll compressor wraps.

Scroll compressors are becoming widely utilized in refrigerant compression applications. As known, scroll compressors include two scroll members each having base and a generally spiral wrap extending from the base. The two spiral wraps interfit to define a plurality of compression chambers. One of the scroll members is driven to orbit relative to the other. In one type scroll compressor, both members orbit and this invention also extends to this type compressor. As the two scroll members orbit relative to each other, the size of the chambers between the scroll wraps are decreased to compress an entrapped fluid.

Traditionally, scroll compressors have had their spiral wraps formed as involutes of a circle. These spiral wraps have a constant generating radius, and thus expand ever increasingly from a common center. These traditional scroll wraps have typically also had constant thicknesses for the wraps. Much of the early design of scroll compressors relied on a model of an idealized scroll wherein the two scroll wraps were perfect involutes, and were both perfectly centered about a common center. However, manufacturing tolerances and variations often result in imperfections, especially near the beginning and ending points of the scroll wraps. These imperfections cause one of the scroll wraps to contact the other scroll wrap prior to the remainder of the scroll wrap coming into contact. That is, due to imperfections in the manufacturing process, there has sometimes been inadvertent contact. This has resulted in undesirable noise.

The prior art has attempted to address this problem by forming a relief in the flanks of the scroll compressors at either the beginning and/or ending points of the wraps. This causes these regions which formally contacted prior to the remainder of the scroll wrap coming into contact, to instead contact at about the same time or even after the remainder of the scroll wrap comes into contact. This process reduced or eliminated the inadvertent contact and correspondingly reduced undesirable noise.

For the traditional scroll wraps which are based on involutes of a circle and which have a constant pitch, or spacing, between successive wraps, rotational misalignment of the two scrolls does not usually cause difficulty with inadvertent contact and any associated undesirable noise. Because successive wraps have equal spacing, i.e., constant pitch, any relative rotation of the wraps causes an equal error to be introduced at each contact point between the wraps and thus the relative contact between wraps is unchanged. Normally, the only problem associated with relative rotation between the wraps is loss of performance as the induced error in contact points causes one set of points to open up to form clearances through which compressed vapor can leak.

More recently, scroll compressor designers have achieved increased operational benefits by scroll wraps which are not formed on an involute of a circle.

As examples, hybrid scroll wraps and high order scroll wraps are often utilized in modern scroll compressors. In these scroll compressors, there is not a constant generating radius along the entire wrap. Some of the scroll wraps are formed of several segments each formed on a circular arc. The segments are connected together to form an entire wrap.

However, across the wrap the generating radius changes. Further, other types of scroll wraps have varying generating radiuses, and varying profiles.

When rotational misalignment occurs with non-uniform generating radius scroll compressors, the initial contact point during rotational misalignment moves. It is no longer necessarily at the beginning or end of the wrap. It may also move instantaneously from one portion of the wrap to another during operation, thus causing a series of inadvertent contacts. This multiplies the potential for undesirable noise. Thus, the above discussed solution is not applicable to scroll compressors having a non-uniform generating radius.

SUMMARY OF THE INVENTION

In the disclosed embodiment of this invention, a scroll compressor is provided wherein the flank wraps are relieved based upon the generating radius at the location on the wrap. Applicant has recognized that undesirable contact is most likely to occur at areas with a higher generating radius. Thus, the greater the generating radius, the more relief that is provided. If the generating radius is below a minimum, then no flank relief may be necessary. The designer might rely upon the assumption that the contact which will occur will occur at the higher generating radius locations where relief is used. It is beneficial to minimize the amount of relief, as the relief does reduce the capacity of the compressor.

In one embodiment, the relief is proportional to the generating radius, at least for areas where the generating radius is over a predetermined minimum.

These and other features of the present invention can be best understood from the following specification and drawings, the following of which is a brief description.

DETAILED DESCRIPTION OF A PREFERRED EMBODIMENT

Figure 1A:
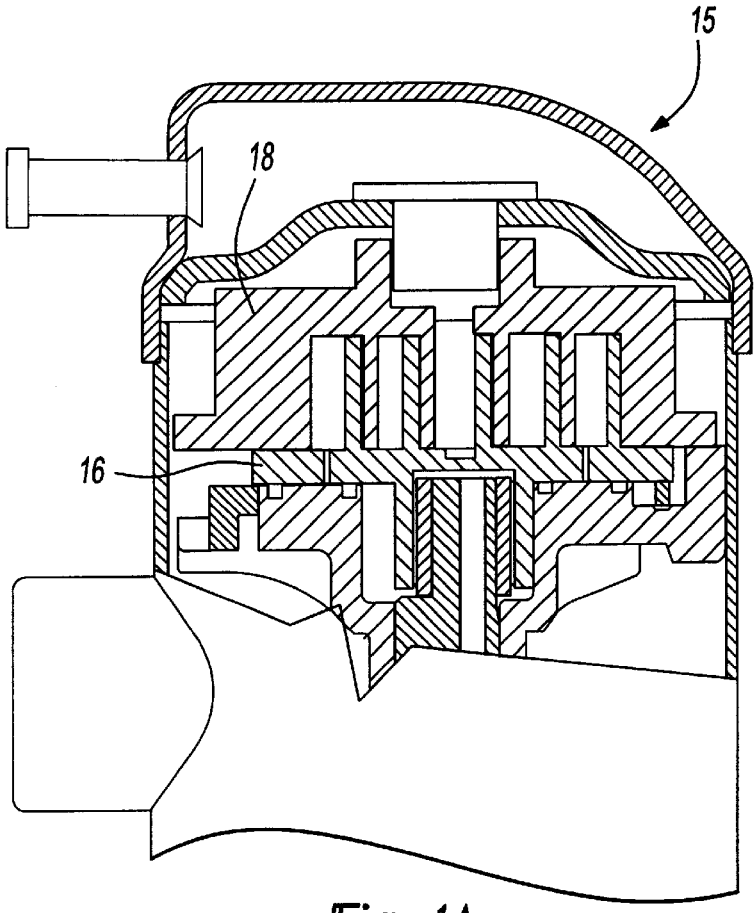
FIG. 1A shows a scroll compressor.

A scroll compressor 15 is illustrated in FIG. 1A. As shown, an orbiting scroll member 16 has a wrap which interfits with the wrap of a non-orbiting scroll member 18. As known, the orbiting scroll is driven to orbit relative to the nonorbiting scroll.

Figure 1B:
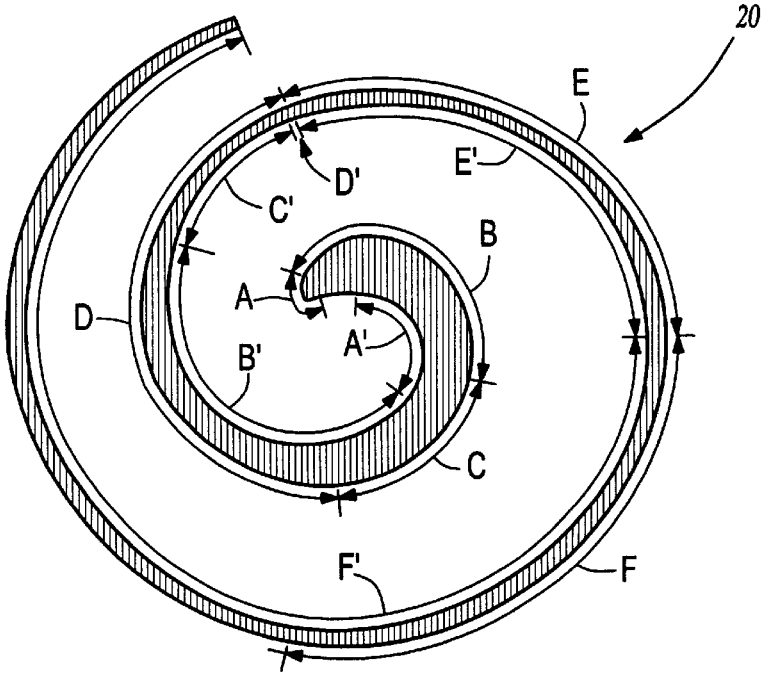
FIG. 1B shows a portion of an example scroll wrap having a non-uniform generating radius.

A portion of a scroll compressor wrap 20 from one of scrolls 16, 18 is illustrated in FIG. 1B. Wrap 20 is an example of a current production wrap. it must be understood that this invention extends to any scroll compressor having a non-uniform generating radius, and not just wrap 20.

Figure 2:
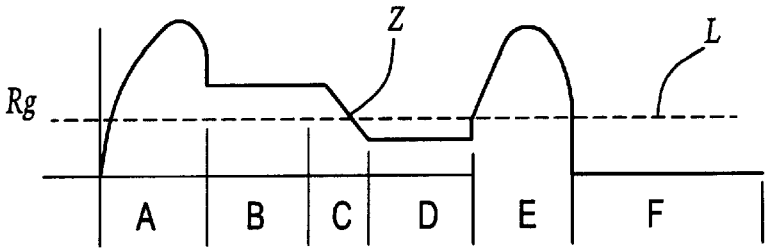
FIG. 2 is a graphical view of the generating radius of a scroll compressor such as shown in FIG. 1B.

As shown, scroll wrap 20 has areas A–F and $A^1$–$F^1$ having different generating radii. The generating radii of same portions are relatively small as shown in FIG. 2. Thus, no flank relief may be necessary at those areas. The generating radii at other portions is greater. For that reason, flank relief may be necessary at those areas. It is the portions such as A and E with higher generating radii which are likely to contact the opposed scroll wrap if rotational misalignment occurs. Thus, by forming the reliefs over portions such as A and E the present invention will reduce undesirable contact and the operational noise.

FIG. 2 shows the generating radius $R_g$ for the scroll compressor of FIG. 1B. As shown, the generating radius increases upwardly over area A and then drops. From the end of area A, the generating radius is constant through area B. From the end of area B the generating radius decreases through area C. A constant relatively low generating radius area occurs over area D. The generating radius increases over area E, and from area E the generating radius again decreases to a constant low generating radius over area F. Through area F the generating radius is low and constant. As can be appreciated from FIG. 1B, there is an inner wrap and an outer wrap, and there are areas $A^1$–$F^1$ and A–F on the respective sides. The areas differ in their extent on the inner and outer wraps.

Figure 3:
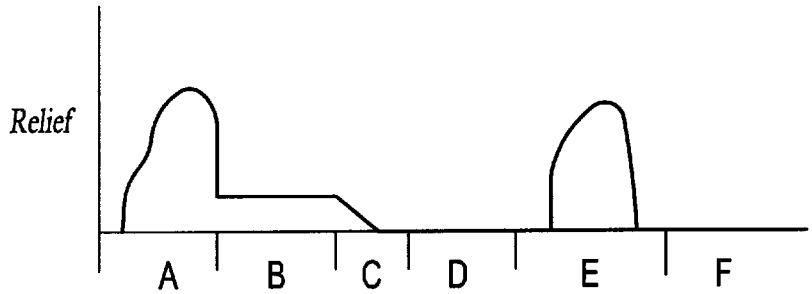
FIG. 3 is a graphic view of the relief for the scroll compressor of FIGS. 1 and 2.

FIG. 3 shows the possible relief for the scroll compressor along the points illustrated in FIG. 2. As can be seen, through area A, as the radius increases and decreases, the relief is respectively higher and lower. Over areas B relief is constant. Over part of area C the relief decreases downwardly to zero. By the end of area C and all of area D the generating radius is relatively small. At a point Z in area C, the generating radius drops below a predetermined value L. See FIG. 2. When the generating radius drops below L, no relief is necessary. Thus, no relief is necessary over the end of area C and all of area D. Area E has the relief since the generating radius increases again. Notably, at the beginning of both areas A and at or near the end of E, the generating radius may be below L, and thus no relief may be used at those areas. Area F has a generating radius below predetermined minimum L. The designer may determine no flank relief is necessary.

In summary, in the main feature of this invention, the placement and magnitude of a relief on a scroll flank wrap is dictated by the generating radius at each individual points on the wrap.

Figure 4A:
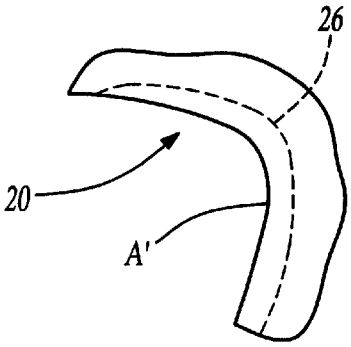
FIG. 4A shows the flank relief over a portion of one side of the scroll wrap of FIG. 1.
Figure 4B:
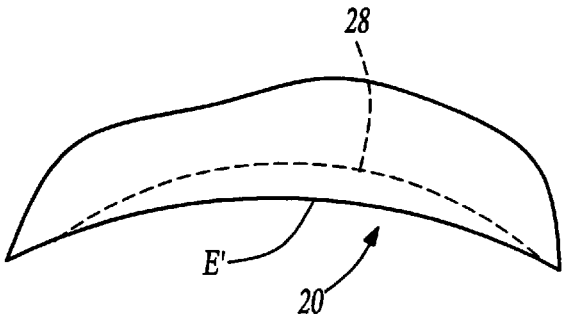
FIG. 4B shows the flank relief over another portion of the FIG. 1 wrap.

FIGS. 4A and 4B show the flank relief 26 and 28, in dotted line, on one flank in the areas $A^1$ and $E^1$. Areas $A^1$–$F^1$ as illustrated have a generating radius similar to that shown in FIG. 2. As should be understood from FIG. 3, area 26 may extend downwardly through area $B^1$ , and a portion of area $C^1$ . The size of the flank relief is greatly exaggerated. In fact, the actual flank relief is very small, and would not be visible in this figure.

In forming the scroll members according to the present invention, the initial design of the wraps is considered. A flank relief is then developed based upon the generating radius of the wrap design. The actual relief is very small, and is exaggerated in FIG. 4A and 4B. The wrap can be cut initially to the final desired profile, including the relief.

Further, while one scroll member is shown in these figures, it should be understood that both scroll members 16 and 18 could have the relief.

Although a preferred embodiment of this invention has been disclosed, a worker of ordinary skill in the art would recognize that certain modifications would come within the scope of this invention. For that reason, the following claims should be studied to determine the true scope and content of this invention.

What is claimed is:

1. A scroll compressor comprising:

a first scroll member having a base and a generally spiral wrap extending from said base;

a second scroll member having a base and a generally spiral wrap extending from said base, at least one of said first and second scroll members orbiting relative to the other; and said generally spiral wrap of a first of said first and second scroll members having a non-uniform generating radius, and a portion of flanks of said first of said one scroll member wrap being cut away at locations where said first scroll member wrap has a higher generating radius.

2. A scroll compressor as recited in claim 1, wherein both of said scroll member wraps have portions relieved at areas of higher generating radius.

3. A scroll compressor as recited in claim 2, wherein said relief is generally proportional to the amount of the generating radius over at least a portion of said scroll member wrap.

4. A scroll compressor as recited in claim 3, wherein said relief is generally proportional to said generating radius at locations where said generating radius is above a predetermined minimum.

5. A scroll compressor as recited in claim 4, wherein no said relief is provided at locations where said generating radius is below said predetermined minimum.

6. A method of designing a scroll compressor comprising the steps of:

designing a scroll wrap geometry, including preparing a non-uniform generating radius;

determining a relief from a flank of said scroll wrap by designating a relief for areas having higher generating radius; and forming said scroll wrap by cutting said scroll wrap, and removing said relief from the flank of said scroll wrap.

7. A scroll compressor comprising:

a first scroll member having a base and a generally spiral wrap extending from said base;

a second scroll member having a base and a generally spiral wrap extending from said base, one of said first and second scroll members orbiting relative to the other; and said generally spiral wrap of a first of said first and second scroll members having a non-uniform generating radius, and an outer portion of flanks of said first scroll wrap being cut away at locations where said first scroll wrap has a higher generating radius, said cut away being generally proportional to said generating radius over at least a portion of said at least one scroll wrap, and at areas having a generating radius above a predetermined minimum, and portions of said first wrap having said generating radius below said predetermined minimum having no said cut away.

* * * * *